United States Patent [19]

Wey

[11] Patent Number: 4,638,956

[45] Date of Patent: Jan. 27, 1987

[54] TEXTILE MACHINE FOR PRODUCING CROSS-WOUND BOBBINS

[75] Inventor: Edmund Wey, Nettetal, Fed. Rep. of Germany

[73] Assignee: W. Schlafhorst & Co., Moenchengladbach, Fed. Rep. of Germany

[21] Appl. No.: 781,974

[22] Filed: Sep. 30, 1985

[30] Foreign Application Priority Data

Sep. 29, 1984 [DE] Fed. Rep. of Germany ..... 3435951

[51] Int. Cl.[4] ..... B65H 54/20; B65H 67/04

[52] U.S. Cl. ..... 242/35.5 A

[58] Field of Search ..... 242/35.5 A, 35.5 R, 242/35.6 R; 57/268, 270, 271, 272

[56] References Cited

U.S. PATENT DOCUMENTS

| | | | |
|---|---|---|---|
| 3,791,126 | 2/1974 | Kose et al. | 242/35.5 A |
| 3,987,974 | 10/1976 | Mayer | 242/35.5 A |
| 4,066,218 | 1/1978 | Kamp | 242/35.5 A |
| 4,154,411 | 5/1979 | Kamp et al. | 242/35.5 A X |
| 4,171,779 | 10/1979 | Kamp | 242/35.5 A |
| 4,178,748 | 12/1979 | Stahlecker et al. | 242/35.5 A X |
| 4,340,187 | 7/1982 | Schippers et al. | 242/35.5 A |
| 4,351,494 | 9/1982 | Schippers et al. | 242/35.5 A |
| 4,352,466 | 10/1982 | Baumges et al. | 242/35.5 A X |
| 4,399,951 | 8/1983 | Preuhs | 242/35.5 A X |

*Primary Examiner*—Stanley N. Gilreath

*Attorney, Agent, or Firm*—Herbert L. Lerner; Laurence A. Greenberg

[57] ABSTRACT

A textile machine assembly includes a textile machine for producing cross-wound bobbins, the textile machine having a head end, bobbin winding stations and a cross-wound bobbin collector disposed at the head end of the machine; a bobbin changer machine traveling from winding station to winding station for exchanging fully wound individual cross-wound bobbins for empty or partially wound tube sleeves at the winding stations and for transporting individual cross-wound bobbins from the winding stations to the collector; and a device disposed at least at one of the machines for causing the bobbin changer machine to transport cross-wound bobbins to the collector after each bobbin exchange has occurred and before beginning another bobbin exchange.

4 Claims, 5 Drawing Figures

TEXTILE MACHINE FOR PRODUCING CROSS-WOUND BOBBINS

The invention relates to a textile machine for producing cross-wound bobbins or cheeses with a traveling bobbin changer which exchanges finished or fully wound individual bobbins with an empty or partially wound tube sleeve at the bobbin winding stations, and a collector for the cross-wound bobbins disposed at the head end of the machine.

Such textile machines are known as winding machines, or open-end spinning machines, for instance. The cross-wound bobbin changer transfers each exchanged spool to a transporting device, which transports this cross-wound bobbin, in some cases together with other bobbins, to the cross-wound bobbin collector, which is disposed at the head-end of the machine.

For example, conveyor belts have been used as conventional transporting devices. However, there are also transporting devices which can travel.

Since the transporting devices are complex and costly, require a great deal of space and in some cases make it necessary to increase the surface area required for the machine, it is accordingly an object of the invention to provide a textile machine for producing cross-wound bobbins which overcomes the hereinafore-mentioned disadvantages of the heretofore-known devices of this general type, and to simplify the removal of the finished cross-wound bobbins, while reducing the space required at the same time.

With the foregoing and other objects in view there is provided, in accordance with the invention, a textile machine assembly, comprising a textile machine for producing cross-wound bobbins, the textile machine having a head end, bobbin winding stations and a cross-wound bobbin collector disposed at the head end of the machine; a bobbin changer machine traveling from winding station to winding station for exchanging fully wound individual cross-wound bobbins for empty or partially wound tube sleeves at the winding stations and for transporting individual cross-wound bobbins from the winding stations to the collector; and means disposed at least at one or both of the textile and bobbin changer machines for causing the bobbin changer machine to transport cross-wound bobbins to the collector after each bobbin exchange has occured and before beginning another bobbin exchange.

In other words, the assembly includes means for prioritizing the transport of cross-wound bobbins to the collector over bobbin exchanges with the bobbin changer machine after each bobbin exchange.

Consequently, the need for a separate transporting device or transporting means for the finished cross-wound bobbins or cheeses is eliminated in this way. An additional advantage lies in the fact that the bobbin changer is better utilized, because it performs transporting operations during the repeated waiting times, which previously were required between the regular exchange operations. Since the transport of bobbins to the collector has priority over bobbin changes, the bobbin changer can immediately travel with each finished cross-wound bobbin to the head end of the machine, to transfer the bobbin to the bobbin-collector at that location. It is only subsequently that the bobbin changer is available for the bobbin exchange function.

In accordance with a concomitant feature of the invention, the textile machine includes a central magazine for tube sleeves at the head end of the machine, and the bobbin changer machine includes means for accepting at least one tube sleeve from the central magazine when transporting a cross-wound bobbin to the collector.

Through the use of this measure, the individual magazines otherwise required at each bobbin winding station can be omitted. A central magazine for the tube sleeves also permits a better control over the tube sleeve supply for the textile machine. The contents of such a central magazine can be more easily observed than the contents of individual magazines conventionally disposed alongside the textile machine. The cross-wound bobbin changer itself does not need to accomodate more than one tube sleeve, because a buffer supply is only useful if it is likely that a tube sleeve may become lost during the transport or the bobbin exchange operation.

Other features which are considered as characteristic for the invention are set forth in the appended claims.

Although the invention is illustrated and described herein as embodied in a textile machine for producing cross-wound bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
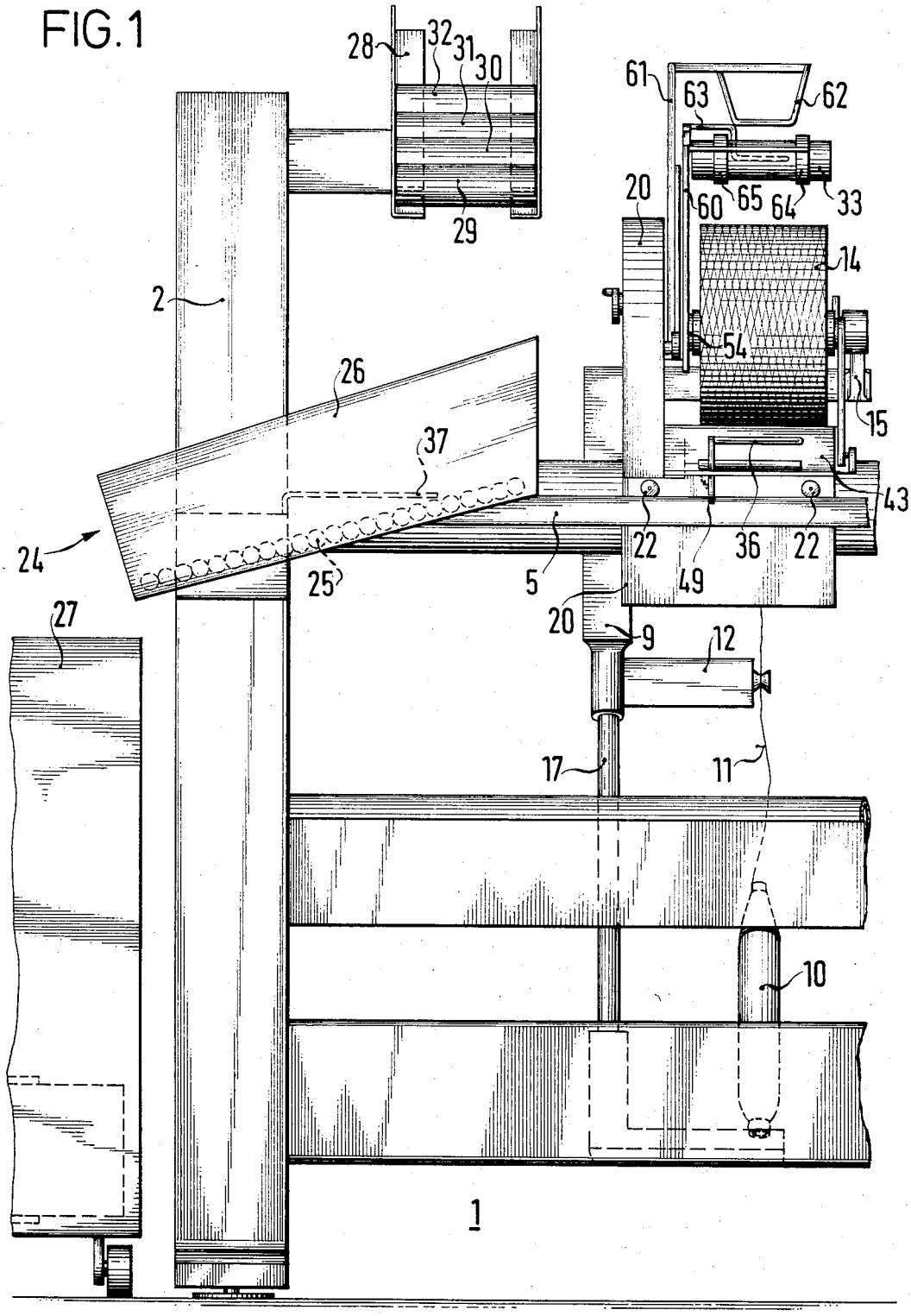
FIG. 1 is a fragmentary, diagrammatic, front-elevational view of a winding or spooling machine according to the invention.
Figure 2:
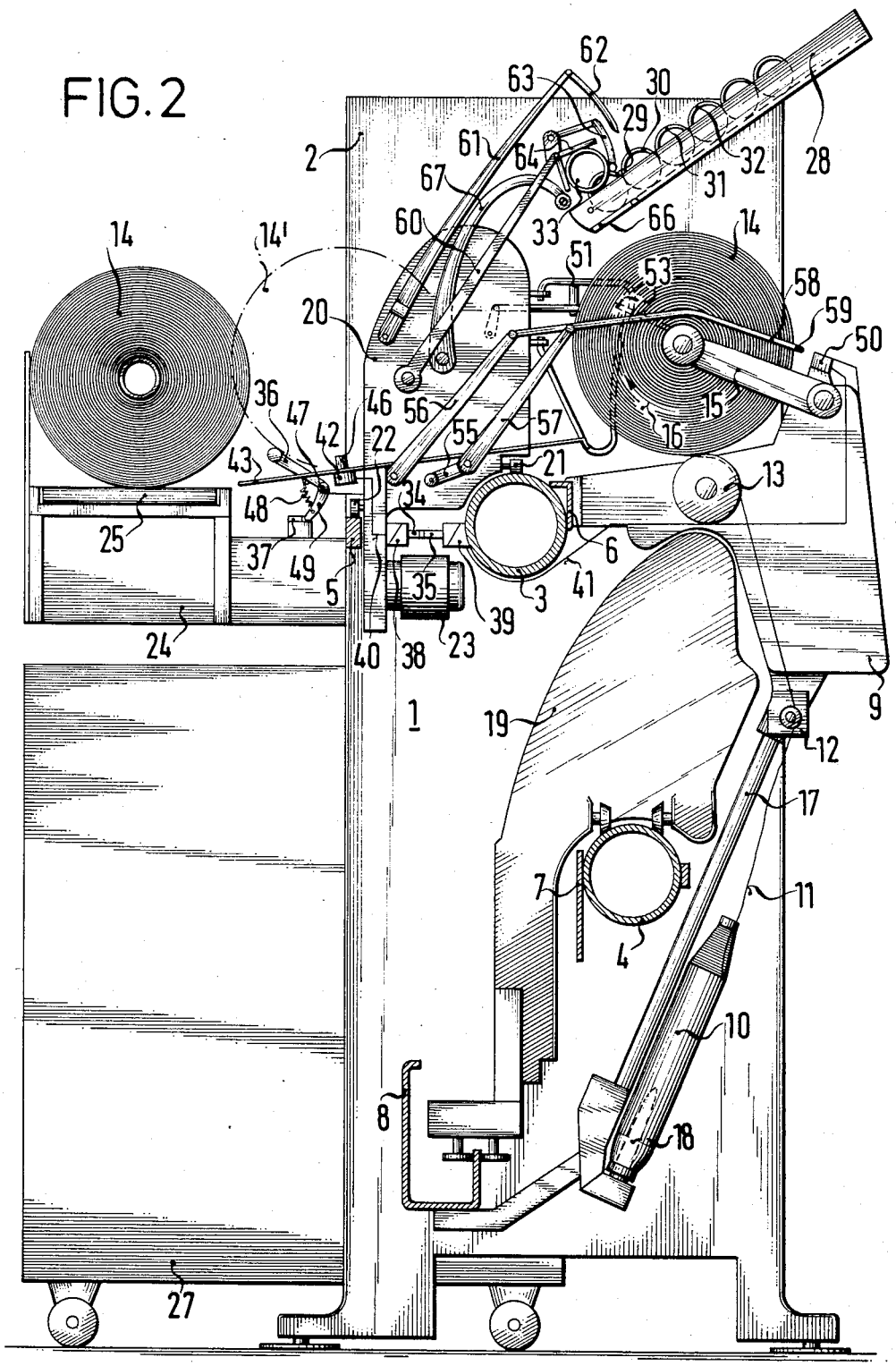
FIG. 2 is a side-elevational view of the winding machine shown in FIG. 1.
Figure 3:
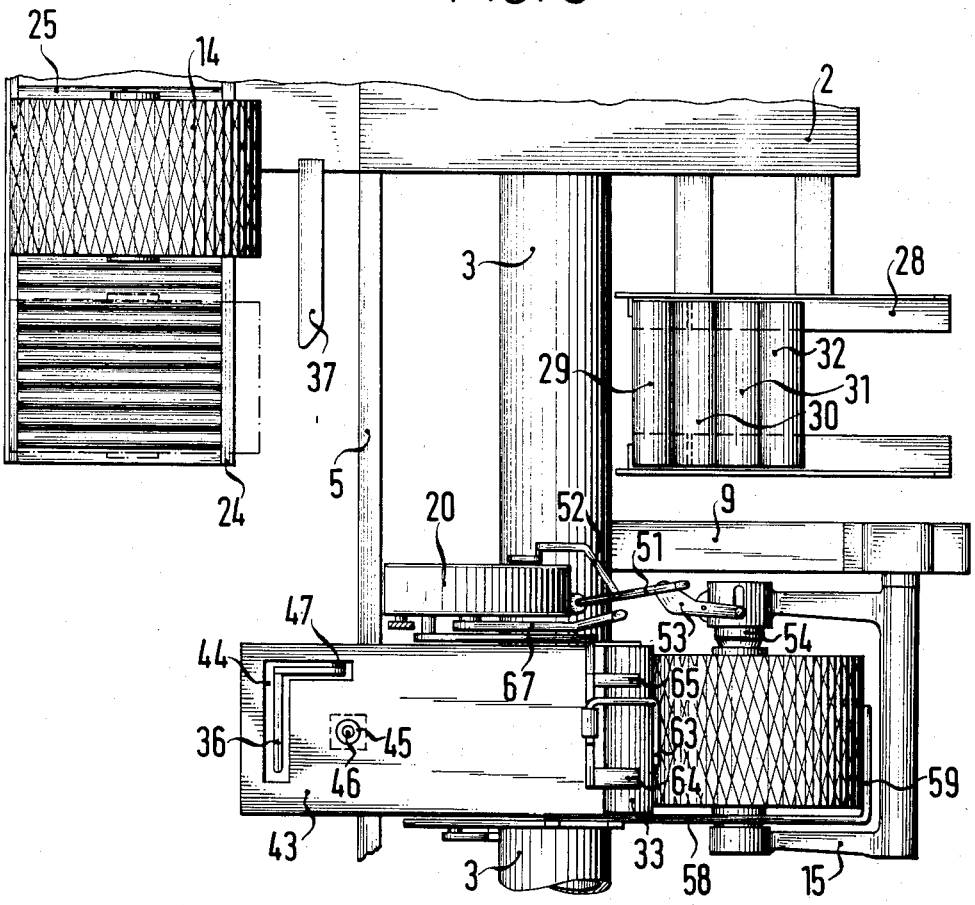
FIG. 3 is a fragmentary top-plan view of the winding machine shown in FIGS. 1 and 2.

Referring now to the figures of the drawings in detail and first, particularly, to FIGS. 1–3 thereof, it is seen that the textile machine as a whole is designated by reference numeral 1 and is constructed as a winding machine. The winding machine has two end frames although FIGS. 1–3 show only one end frame 2. The end frames are connected with each other by tubular traverses 3 and 4, rails 5, 6, and cross pieces 7, 8. Individual winding stations 9 for producing cross-wound bobbins or cheeses (a total of ten stations), are fastened to the tubular traverses and cross pieces.

Since this textile machine for producing cross-wound bobbins is an automatic winding machine, each station 9 for producing cross-wound bobbins is provided with a creel bobbin or run off spool 10 which supplies a thread 11. In the case of an open-end spinning machine, a spinning device would supply the thread. The thread 11 runs through a thread tensioner 12 and is then conducted to a cross-wound bobbin or cheese 14 over a winding roller 13, which is provided with reverse winding grooves. The cross-wound bobbin or cheese 14 is rotatably supported in a pivotable winding frame 15, it lies on the winding roller 13 and it is driven by the winding roller 13 in the direction of an arrow 16. A linkage 17 which extends down to the cross piece 8, carries the thread tensioner 12 and a mounting pin 18 for the run off spool 10.

A thread joining device 19 which can travel back and forth on the tubular traverse 4 is provided for producing a thread joint when necessary.

A cross-wound bobbin changer 20 is also capable of traveling back and forth on the tubular traverse 3 and on the rail 5, by means of rollers 21 and 22. The rollers are therefore driven by a motor 23.

The cross-wound bobbin changer 20 serves several functions. At the winding stations for the cross-wound bobbins, the bobbin changer automatically exchanges the finished individual bobbins with empty tube sleeves and it also functions as a transporting device for individual spools and tube sleeves.

In its function as transporter for individual spools, the bobbin changer has the capability of transporting and delivering an individual exchanged spool in a transport position 14' shown in FIG. 2, from the cross-wound bobbin production location to a cross-wound bobbin collection location or collector 24, which is disposed at the head end of the machine. The collection location 24 for the cross-wound bobbins has an inclined roller conveyor 25, which is flanked by a guard 26, and ends above a movable transport container 27. For example, as soon as a finished cross-wound bobbin 14 is located on the conveyor 25, as shown in FIG. 2, it travels by gravity along the roller conveyor and finally drops into the transport container 27. A non-illustrated, switchable holding back device is provided at the end of the bobbin collection location 24 in order to hold back bobbins on the roller conveyor 25 during the time that the transport container is echanged.

It is self-evident that the cross-wound bobbins can also be removed from the bobbin collection location 24 in a different way. If required, the acceptance capacity of the bobbin collector or collection location can be considerably greater than illustrated in the drawing.

A central magazine 28 for the tube sleeves 29 to 33 is also located at the head end of the machine. The capacity of this central magazine 28 for holding sleeves can also be considerably greater than illustrated in the drawing.

At the winding machine 1, as well as at the cross-wound bobbin changer 20, means are provided for the travel of the bobbin changer 20 for transporting the individual spool 14 to the spool collector 24, in such a way that this travel always has priority. These means include a control finger 34, a controllable bobbin hold-back device 36 at the bobbin changer 20, and a switching rail 37 at the end frame of the winding machine 1, which operates and controls the bobbin hold-back device 36.

Figure 4:
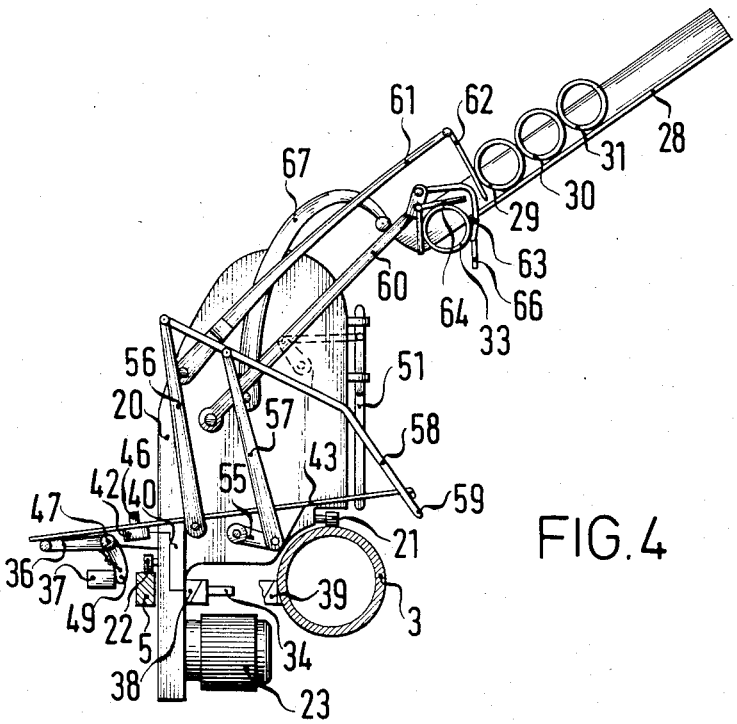
FIGS. 4 and 5 are side-elevational views showing details of a cross-wound bobbin changer.
Figure 5:
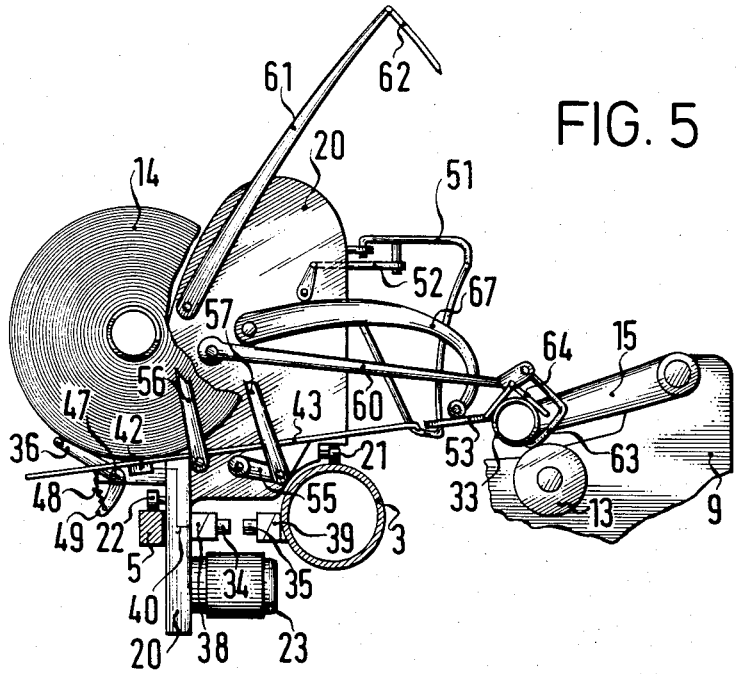

The control finger 34 is switched on and off by an electro-magnetic drive 38. The electro-magnetic drive 38 is connected by an operative or functional connection 40 to a micro-switch 42, which is located below an inclined work table 43. The table 43 has two cutouts shown in FIG. 3. A first cutout 44 for the bobbin hold-back device 36 and a second cutout for a plunger 46 of the micro-switch 42, are formed in the table 43. If the plunger 46 is under a load provided by an individual spool 14 which lies on the table 43 as shown in FIG. 5, the micro-switch 42 is in the "on" position, the switch actuates the electro-magnetic drive 38 through the connection 40, and after a preset delay time, the drive 38 retracts the finger or latch 34. If the plunger 46 is not under a load provided by an individual bobbin, as shown in FIG. 4, the micro-switch 42 is in the "off" position, and the electro-magnetic drive is not activated. In this case the finger or latch 34 remains pushed out by a spring force.

The bobbin hold-back device 36 is constructed in the form of an angle lever, which is pivotable about a horizontal axis 47. A tension spring 48 biases a control arm 49 of the hold-back device in such a way that the bobbin hold-back device 36 pivots upward through the cutout 44 and holds back a bobbin which rolls down on the table 43, as shown in FIG. 5. When the cross-wound bobbin changer 20 comes close to the end frame 2, the control arm 49 moves up on the switching rail 37, which is chamfered at the front thereof, whereby the spool hold-back device 36 swings back around the pivot axis 47, so that it is positioned below the table 43, as shown in FIG. 4.

The control finger 34 of the bobbin changer 20 works in conjunction with control fingers 35, which are provided at each cross-wound bobbin winding station 9. Each control finger 35 can be retracted from the forward position by an electro-magnetic actuator 39, as shown in FIG. 5. According to FIG. 2, the electro-magnetic actuator 39 is connected through an operative or functional connection 41 with a frame monitor 50. Through the functional connection 41, the frame monitor 50 keeps the electro-magnetic actuator 39 in the activated state, during the time that the cross-wound bobbin is not completely wound. As soon as the cross-wound bobbin has reached the desired diameter, the bobbin frame 15 turns off the frame monitor 50, which is a micro-switch, and the electro-magnetic actuator 39 loses its current, so that the control finger 35 is pushed forward by the force of a spring, as shown in FIG. 2, for example.

If the cross-wound bobbin changer 20 is not in operation, it shuttles back and forth along the tubular traverse 3 passing the winding stations and remaining ready for further action. The control finger 34 of the bobbin changer 20 is therefore in the extended position. As soon as any of the frame monitors 50 reports a finished bobbin, the control finger 35 of the respective bobbin winding station is also extended or pushed out and therefore extends into the travel path of the control finger 34. When the bobbin changer 20 comes close to the winding station which requests a bobbin change, the control finger 34 of the bobbin changer hits the control finger 35 of the bobbin winding station, so that the bobbin changer 20 stops there, turns off its drive motor 23 by non-illustrated means, and positions itself in front of the bobbin winding station. At the same time, a non-illustrated group of cam discs is set in motion to exchange the cross-wound bobbin in the following manner:

A linkage 52 moves a frame-opening member 51 from its rest position shown in FIG. 4 to its operating position shown in FIG. 5, and thereby moves a lever 53 laterally, so that the tube sleeve plate 54 shown in FIG. 1, which elastically connects the tube sleeve of the bobbin 14 with the bobbin frame 15 by spring action, is pushed to the side. The finished or wound cross-wound bobbin or cheese 14 is thereby released from the bobbin frame 15. A crank 55 simultaneously rotates and moves a linkage 56, 57, 58. The linkage is disposed at the side of the bobbin changer 20 and it carries a horizontally-positioned fetching arm 59. The fetching arm 59 swings clockwise around the cross-wound bobbin 14, as shown in FIG. 2, it grabs the back of the bobbin with its motion and it brings the bobbin forward, so that it rolls onto the table 43 and finally comes to rest in front of the bobbin hold-back device 36, as shown in FIG. 5. Since the bobbin changer 20 also functions as a tube sleeve transporting device, it includes means for taking at least one tube sleeve out of the central magazine 28 during the transport of the bobbin. These means include a tube sleeve holder 60 and a pivotable magazine lock 61.

FIG. 4 shows the transfer of a sleeve 33 from the central magazine 28. The magazine lock 61 swings clockwise from the rest position shown in FIG. 2 and FIG. 5 until a locking beam 62 has positioned itself between the last tube sleeve 33 and the preceding sleeve 29 in the central magazine 28. Simultaneously, the tube sleeve holder 60 also moves downward clockwise, so that an elastically yielding sleeve clamp 63 holds the tube sleeve at one side and two V-shaped sleeve supports 64 and 65 clamp and elastically hold the tube sleeve 33 at the opposite side, as shown in FIG. 1. During the further motion of the sleeve holder 60, a spring-loaded trap door in the bottom of the central magazine 28 moves downward, and the sleeve 33 is removed by the sleeve holder 60 from the central magazine 28, while the magazine lock 61 does not swing further, but remains in the position shown in FIG. 4.

The magazine lock 61 subsequently swings back into its starting position according to FIG. 5, so that the sleeves in the central magazine 28 can slide forward. The sleeve holder 60, which now carries the tube sleeve 33, only swings back to the starting position shown in FIG. 2, if the cross-wound bobbin changer machine 20 has left the head end of the textile machine 1.

The cross-wound bobbin collector 24 is provided opposite the central magazine 28. When the bobbin changer 20 with an individual spool 14 approaches the bobbin collector 24, the control arm 49 contacts the control rail 37, so that the individual spool 14, which lies on the table 43, is released from the bobbin hold-back device 36 and continues to roll onto the roller conveyor 25. Up to this point, the plunger 46 of the micro-switch 42 has been depressed by the cross-wound bobbin 14, thereby causing the retraction of the control finger 34. Consequently, the bobbin changer 20 could not have been arrested by a projecting control finger 35 during its travel to the head end of the winding machine 1. After the load is removed from the plunger 46, the electro-magnetic actuator 38 is automatically turned off, so that the control finger 34 moves forward due to spring action, as shown in FIG. 4. Thus, during the return travel, the bobbin changer 20 can be stopped at the nearest spool winding station, whose control finger 35 is in the extended position, in order to accept a finished or wound bobbin and to transport the bobbin to the cross-wound bobbin collector 24. This always occurs while using the shortest path.

After a cross-wound bobbin has beem removed from its position in the bobbin frame 15, the bobbin changer 20 automatically inserts the tube sleeve which it carries along, into the bobbin frame. According to FIGS. 2 and 5, this is accomplished in the following way:

A pressure lever 67 swings clockwise, so that it places a load on the lever 53 and thereby takes along the whole winding frame 15, as shown in FIG. 5. Simultaneously, the sleeve holder 60 also swings clockwise, and thereby transports the respective tube sleeve 33 to a position in front of the sleeve reception point of the spool frame 15. The frame opening member 51 is still in the swung out position. The tube sleeve 33 is clamped and secured in the winding frame 15 by the return motion of the frame opening member 51 to the starting position thereof, indicated on FIG. 4. The pressure lever 67 and the sleeve holder 60 subsequently also swing back to their starting positions. At this point the cross-wound bobbin changer 20 has finished its operation at the bobbin winding station 9 and it transports the accepted individual spool to the head end of the machine in order to deposit it there and to accept a new tube sleeve at the same time.

The movements of the individual levers are controlled by cam discs, which are located in the interior of the housing of the cross-wound bobbin changer 20. After changing a bobbin, the motor 23 of the traveling mechanism is also activated again by cam discs. The reversal of the direction of the motor at the ends of the travel route can be effected by end switches, which are not shown in the drawings. The electric current is supplied either by rails and slide contacts, or by a trailing cable.

In general, the invention is not limited to the illustrated and described embodiment, which was used as an example.

According to FIG. 2, the collector for the cross-wound bobbins is disposed alongside the end frame 2. Obviously, it is also possible, and in some special cases it is even preferred, to place the bobbin collector behind the end frame, so that the inspection passage behind the winding machine is not obstructed at the end.

I claim:

1. Textile machine assembly, comprising a textile machine for producing cross-wound bobbins, said textile machine having a head end, bobbin winding stations and a cross-wound bobbin collector disposed at said head end of said machine; a bobbin changer machine traveling from winding station to winding station for exchanging fully wound individual cross-wound bobbins for empty or partially wound tube sleeves at said winding stations and for transporting individual cross-wound bobbins from said winding stations to said collector; and means disposed at least at one of said machines for causing said bobbin changer machine to transport cross-wound bobbins to said collector after each bobbin exchange has occurred and before beginning another bobbin exchange.

2. Textile machine assembly, comprising a textile machine for producing cross-wound bobbins, said textile machine having a head end, bobbin winding stations and a cross-wound bobbin collector disposed at said head end of said machine; a bobbin changer machine traveling from winding station to winding station for exchanging fully wound individual cross-wound bobbins for empty or partially wound tube sleeves at said winding stations and for transporting individual cross-wound bobbins from said winding stations to said collector; and means disposed at least at one of said machines for prioritizing the transport of cross-wound bobbins to said collector with said bobbin changer machine after each bobbin exchange.

3. Textile machine assembly according to claim 1, wherein said textile machine includes a central magazine for tube sleeves at said head end of said machine, and said bobbin changer machine includes means for accepting at least one tube sleeve from said central magazine when transporting a cross-wound bobbin to said collector.

4. Textile machine assembly according to claim 2, wherein said textile machine includes a central magazine for tube sleeves at said head end of said machine, and said bobbin changer machine includes means for accepting at least one tube sleeve from said central magazine when transporting a cross-wound bobbin to said collector.

* * * * *